US012546172B2

(12) United States Patent
Salloom et al.

(10) Patent No.: US 12,546,172 B2
(45) Date of Patent: Feb. 10, 2026

(54) COATINGS FOR WEAR SURFACES AND RELATED APPARATUSES, DEVICES, SYSTEMS, AND METHODS

(71) Applicant: CHAMPIONX LLC, Sugar Land, TX (US)

(72) Inventors: Riyadh Salloom, Arlington, TX (US); Ramamurthy Narasimhan, Dallas, TX (US); Justin Green, Fort Worth, TX (US); Neil Thomas, Crowley, TX (US); James Rowan, Burleson, TX (US)

(73) Assignee: CHAMPIONX LLC, Sugar Land, TX (US)

( * ) Notice: Subject to any disclaimer, the term of this patent is extended or adjusted under 35 U.S.C. 154(b) by 0 days.

(21) Appl. No.: 17/705,139

(22) Filed: Mar. 25, 2022

(65) Prior Publication Data

US 2023/0304363 A1 Sep. 28, 2023

(51) Int. Cl.

| | |
|---|---|
| ***E21B 17/10*** | (2006.01) |
| ***E21B 4/00*** | (2006.01) |
| ***E21B 17/03*** | (2006.01) |
| ***E21B 43/12*** | (2006.01) |

(52) U.S. Cl.

CPC ..... *E21B 17/1071* (2013.01); *E21B 4/003* (2013.01); *E21B 17/03* (2013.01); *E21B 17/1085* (2013.01); *E21B 43/121* (2013.01)

(58) Field of Classification Search

CPC .. E21B 17/1071; E21B 17/03; E21B 17/1085; E21B 4/003; F16C 33/043; F16C 2352/00

See application file for complete search history.

(56) References Cited

U.S. PATENT DOCUMENTS

| | | | | |
|---|---|---|---|---|
| 992,576 | A * | 5/1911 | Mead | F16J 9/08 92/182 |
| 4,960,643 | A * | 10/1990 | Lemelson | B28D 1/12 428/688 |
| RE33,767 | E | 12/1991 | Christini et al. | |
| 7,744,685 | B2 | 6/2010 | Lancsek et al. | |
| 8,261,841 | B2 | 9/2012 | Bailey et al. | |
| 8,609,196 | B2 | 12/2013 | Lee et al. | |
| 10,731,258 | B2 | 8/2020 | Thottathil et al. | |
| 2012/0100366 | A1* | 4/2012 | Dumm | C09C 1/44 428/335 |
| 2014/0287208 | A1 | 9/2014 | Feldstein et al. | |
| 2017/0016282 | A1 | 1/2017 | McNease | |
| 2017/0058616 | A1* | 3/2017 | Lunk | E21B 43/128 |
| 2017/0122333 | A1 | 5/2017 | Gray et al. | |
| 2017/0167483 | A1 | 6/2017 | Kool et al. | |
| 2018/0106250 | A1 | 4/2018 | Kool et al. | |
| 2022/0009047 | A1 | 1/2022 | Kim et al. | |
| 2023/0184089 | A1* | 6/2023 | Treiberg | E21B 47/009 702/6 |

* cited by examiner

*Primary Examiner* — D. Andrews

(74) *Attorney, Agent, or Firm* — BKRIP LLC

(57) ABSTRACT

Metal-based ceramic composite coatings and related devices, assemblies, and methods include monocrystalline superhard particles dispersed in a metal matrix disposed on at least one wear surface of a component of an oil and gas well assembly, system, or device.

19 Claims, 6 Drawing Sheets

COATINGS FOR WEAR SURFACES AND RELATED APPARATUSES, DEVICES, SYSTEMS, AND METHODS

TECHNICAL FIELD

Embodiments of the disclosure relate to coatings that may be utilized on one or more wear surfaces of components in an oil and gas well. More specifically, embodiments of the disclosure relate to coatings including monocrystalline superhard elements that may be utilized on one or more wear surfaces of components for use in an oil and gas wells and related assemblies, apparatuses, systems, and methods.

BACKGROUND

Oil and gas well pump and/or artificial lift systems, including downhole and surface pumps, well head, artificial lift equipment (e.g., plunger lifts, jet lifts, rod lifts, blowout preventer (BOP), well head valves, etc.), and the components of the pumps, artificial lift equipment, or related components, are susceptible to wear (e.g., via abrasion and/or erosion), corrosion, and/or scaling when operating for prolonged durations in the wellbore.

The operating environments of oil and gas wells are generally subject to sand particulates, acidic substances, and/or inorganic elements within the well fluid. Oil and gas well components (e.g., artificial lift equipment, pumps, well head, other associated components, etc.) generally wear over time due to a large amount of sand, debris, and/or corrosive fluids within the well fluid pumped through and around the components. Also, oil and gas well pump system components may be susceptible to corrosion due to acidic substances, such as hydrochloric acid, within the well casing. This combined wear and corrosion will generally degrade the pumps, lift systems, well head, and other downhole components. Such degradation may shorten anticipated service life of the pump system and related components and may increase unplanned downtime maintenance costs. Moreover, oil and gas well system components are susceptible to scaling due to accumulation of corrosion products and inorganic material on surfaces of the components. Such accumulation may coat downhole components, thereby, limiting production, shortening anticipated service life of the systems and components, and/or increasing unplanned component downtime and maintenance costs.

SUMMARY

In some aspects, the techniques described herein relate to an assembly for an oil and gas well system, the component including: a first component having a first wear surface; a second component having a second wear surface that at least partially contact the first wear surface of the first component during relative movement between the first component and the second component; and a metal-based ceramic composite coating on at least a portion of at least one of the first wear surface of the first component or the second wear surface of the second component, the metal-based ceramic composite coating including monocrystalline superhard particles dispersed in a metal matrix.

In some aspects, the techniques described herein relate to a component for use in an oil and gas well system, the component including: an element having a wear surface configured to move relative to and at least partially contact another component of the oil and gas well pumping assembly; and a metal-based ceramic composite plating on at least a portion of the wear surface, the metal-based ceramic composite plating including superhard monocrystalline particles dispersed in a metal matrix.

In some aspects, the techniques described herein relate to a method of producing a metal-based ceramic composite coating on at least a portion of a wear surface of a component for use in an oil and gas well pumping assembly, the method including: positioning the at least a portion of the wear surface of the component in a bath including monocrystalline superhard particles in a metal plating bath (e.g., an autocatalytic metal plating bath); coating the at least a portion of the wear surface of the component with a coating including the monocrystalline superhard particles and the metallic fluid matrix; removing the component from the bath; and heat treating the at least a portion of the wear surface of the component.

According to some embodiments, the techniques described herein relate to a downhole pump including: a barrel including an interior cavity defined by an inner surface of the barrel; a plunger having an outer surface; a valve rod mechanically connected to the plunger and configured to drive the plunger within and relative to the interior cavity of the barrel, the outer surface of the plunger being in at least partial contact with the inner surface of the barrel as the outer surface of the plunger moves relative to the inner surface of the barrel; and a metal-based ceramic composite coating on at least a portion of at least one of the inner surface of the barrel or the outer surface of the plunger, the metal-based ceramic composite coating including monocrystalline diamond particles dispersed in a metal matrix.

According to some embodiments, the techniques described herein relate to a downhole pump including: a plunger having an outer surface and moves in tubing from well foot to well head with pressure difference between the upper and lower section of the plunger, the outer surface of the plunger being in at least partial contact with the inner surface of the tubing as the outer surface of the plunger moves relative to the inner surface of the tubing; and a metal-based ceramic composite coating on at least a portion of at least one of the inner surface of the tubing or the outer surface of the plunger, the metal-based ceramic composite coating including monocrystalline diamond particles dispersed in a metal matrix.

According to some embodiments, the techniques described herein related to a downhole ESP pump system including an impeller having outer and contact faces and a diffuser having inner and contact surfaces configured to drive the impeller to rotate on about an axis with respect to diffuser. The outer surface and/or the impeller contact faces are in at least partial face contact and/or configured with a running air gap between the diffuser inner surface and/or face contact. The system further includes a metal-based ceramic composite coating on at least a portion of at least one of the inner surface and/or contact of the diffuser or the outer surface and/or contact faces of the impeller, the metal-based ceramic composite coating including monocrystalline diamond particles dispersed in a metal matrix.

In some aspects, the techniques described herein relate to a downhole component for use in an oil and gas well pumping assembly, the downhole component including: a downhole element having an erosion surface configured by fluid move relative to and at least partially contact another component of the oil and gas well pumping assembly; and a metal-based ceramic composite plating on at least a portion of the wear surface, the metal-based ceramic composite plating including superhard monocrystalline particles dispersed in a metal matrix.

In some aspects, the techniques described herein relate to a downhole component for use in an oil and gas well pumping assembly, the downhole component including: a downhole element having a wear surface configured to move relative to and at least partially contact another component of the oil and gas well pumping assembly; and a metal-based ceramic composite plating on at least a portion of the wear surface, the metal-based ceramic composite plating including superhard monocrystalline particles dispersed in a metal matrix.

Features from any of the embodiments contemplated by the instant disclosure may be used in combination with one another, without limitation, in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION

Figure 1:
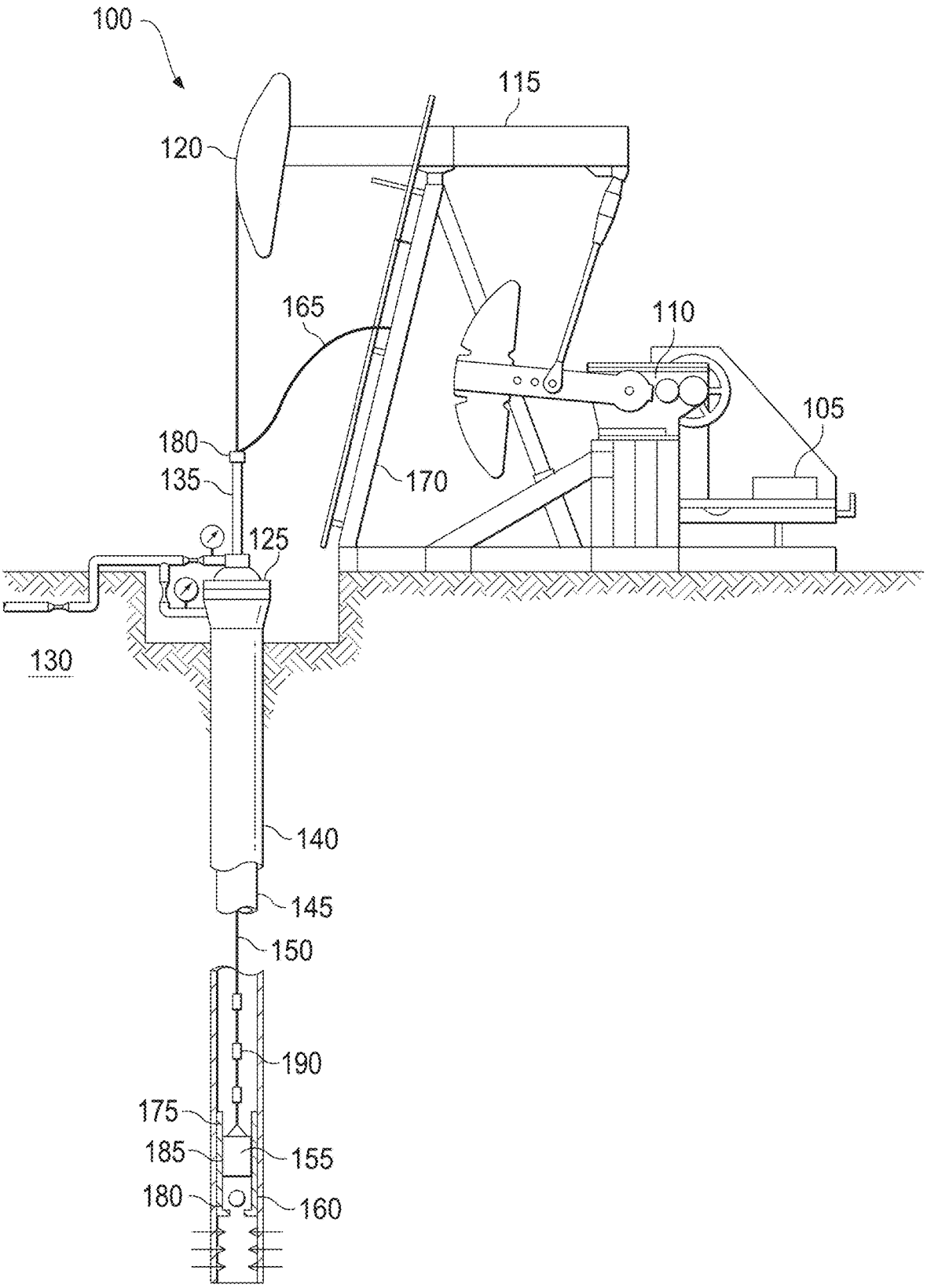
FIG. 1 is an elevational view of a pumping system according to embodiments of the disclosure.

As used herein, the term "substantially" or "about" in reference to a given parameter means and includes to a degree that one skilled in the art would understand that the given parameter, property, or condition is met with a small degree of variance, such as within acceptable manufacturing tolerances. For example, a parameter that is substantially met may be at least 90% met, at least 95% met, at least 99% met, or even 100% met.

As used herein, the term "fluid" may mean and include fluids of any type and composition (e.g., a flowable composition). Fluids may take a liquid form, a gaseous form, or combinations thereof, and, in some instances, may include some solid material. In some embodiments, fluids may convert between a liquid form and a gaseous form during a cooling or heating process. In some embodiments, the term fluid includes gases, liquids, and/or pumpable mixtures of liquids and solids.

The terms "superabrasive" and "superhard," as used herein, may refer to any material having a hardness that is substantially at least equal to, or greater than, a hardness of tungsten carbide. For example, a superhard article may represent an article of manufacture, at least a portion of which may exhibit a hardness that is substantially equal to or greater than the hardness of tungsten carbide.

In some embodiments, superhard particles or materials disclosed herein may include superhard particles in a monocrystalline configuration. For example, the particles may substantially exhibit a single crystalline structure having a substantially single grain orientation, The single crystalline structures may substantially lack grain boundaries within the monocrystalline particles as opposed to polycrystalline structures that are typically implemented in coatings for downhole applications. Stated in another way, the monocrystalline particles substantially do not comprise a polycrystalline structure having multiple grain orientations that define grain boundaries between the crystallites of varying size and/or orientation defining the polycrystalline structure.

In some embodiments, the monocrystalline particles or materials may comprise monocrystalline diamond, monocrystalline cubic boron nitride (CBN), silicon monocrystalline carbide, monocrystalline intermetallic (e.g., carbides) or ceramics, and/or mixtures or composites including one or more of the foregoing materials, without limitation.

Some embodiments of the coating disclosure herein may be utilized on one or more components of an oil and gas well pumping assembly (e.g., downhole and/or surface components of the system). For example, such coatings may be used on artificial lift systems and related components (e.g., downhole pumps, plunger lifts, jet lifts, rod lifts, electrical submersible pumps (ESPs), etc.). In additional embodiments, such coatings may be implemented on oil and gas well production components, for example, drilling rig equipment, marine riser systems, tubular goods (e.g., casing, tubing, and drill strings), wellhead, trees, and valves, completion strings and equipment, formation and sand face completions, artificial lift equipment, well intervention equipment, and combinations thereof.

Such coatings implemented on oil and gas well components may facilitate a relative extension of operation in harsh oil and gas well environments as compared to similar components lacking such coatings. Specifically, oil and gas well components may be fabricated from a substrate (e.g., a metallic substrate) having a surface (e.g., a surface with complicated geometry). Coatings according to embodiments of the disclosure may be applied to the surface to facilitate increased service life of the well components. More specifically, some of the components may include coatings according to embodiments of the disclosure including a coating mixture that includes a combination of superhard particles (e.g., monocrystalline particles) and a metallic matrix composition (e.g., including nickel, phosphorous, cobalt, and/or chromium) as a plating solution.

The component coatings described herein may offer advantages that include, without limitation, wear-resistance, corrosion-resistance, and/or scaling-resistance. The oil and gas well components with the coatings described herein may facilitate increasing the service life of the associated components and systems by providing components having wear surfaces with greater reliability. Additionally, the component coatings may facilitate increasing service intervals, thereby resulting in systems that are less costly to operate over time when compared to other components lacking such coatings.

In some embodiments, the monocrystalline structure of the superhard particles in the coating may offer better breakage and/or shear resistance, as compared to polycrystalline particles due, for example, to the absence of grain boundaries within the single crystalline particles.

In some embodiments, using single crystalline particles instead of the polycrystalline particles may reduce cleavage and/or fracture of particles during high pressure contact during operation with sand particles and/or hard surfaces that are typically found in downhole applications. Such solid particles (e.g., sand) are generally present in crude oil and during operation of well components, such as, for example, in the plunger stroke up and down in a downhole pump. These particles may come into contact with the barrel and/or the plunger surfaces of the pump, tubing and/or plunger, impeller and/or diffuser, causing abrasion and wear. Such sand is composed mainly of a silica compound (e.g., $SiO_2$) and exhibits a relatively lower hardness than superhard materials, such as diamond. Accordingly, coatings including the single crystalline particles in a metallic matrix may withstand the contact forces and resist the abrasion damage induced by hard particles, such as sand.

In some embodiments, the coatings may be polished or honed after application of the coatings on the components, as discussed below in greater detail. For example, finishing operations to the coating may include subjected the coating to a polishing technique to reduce the surface roughness of the coated surface and prepare the components for interaction with other parts (e.g., sliding interaction of components). In some embodiments, the polishing technics may include high abrasive ceramics that are used to smooth out the surface and decrease the friction coefficient. The single crystalline or monocrystalline particles may develop a relatively lower friction coefficient by the virtue of the high breakage and/or shear resistance of the monocrystalline particles as compared to polycrystalline particles. For example, such polycrystalline particles may tend to break due to the different orientations of the varying grains in polycrystalline particles. Therefore, the tribolayer formed during the sliding contact of single crystalline or monocrystalline particles may exhibit relatively more desirable frictional characteristics as compared polycrystalline diamond.

The present disclosure relates, in some embodiments, to reciprocating sucker rod pumping systems (e.g., pumping system) that transport oil from oil wells. Such sucker rod pumping systems may function on the positive displacement principle used by cylinder and piston pumps. As discussed below, the coatings may be applied to other components, such as, for example, in other artificial lift system components (e.g., electronic submersible pumps, plunger and jet lift systems, jet pumps, wellhead valves, thrust bearings, valves, etc.).

FIG. 1 illustrates the basic components of a sucker rod pumping system 100. As shown in FIG. 1, the basic sucker rod pumping system 100 components include a motor base 105, a gearbox 110, a walking beam 115, a horsehead 120, a wellhead 125, a flowline 130, a polished rod 135, a casing 140, a tubing 145, a rod string 150, a plunger 155, cable 165, Samson beam 170, and a barrel 160.

Such sucker-downhole pumping systems 100 typically admit fluids from the bottom end (down well) and discharge the fluids from the top end of the pump. Since the pump may be placed in non-vertical sections of the well, "top" and "bottom" labels may become unclear, hence, in the present disclosure "top" refers to the uppermost point or the point closest to the surface along a path of the well. Similarly, "bottom" refers to the lowermost point or the point farthest from the surface along the path of the well.

Further, when used herein in reference to a location in the wellbore, the terms "above," "upper," and "uphole" mean and include a relative position proximate the surface of the well, whereas the terms "below," "lower" and "downhole" mean and include a relative position distal the surface of the well.

The motor base 105 provides the driving power to the system 100 and can be an electric motor or a gas engine. The gearbox 110 reduces the high rotational speed of the motor base 105 into the reciprocating motion required to operate the downhole pump 175. The main element of the gearbox 110, the walking beam 115, functions as a mechanical lever that adjusts the position of the horsehead 120 that is connected to the polished rod 135. The Samson beam 170 serves as a vertical stabilizing leg to hold up the horsehead 120 and the walking beam 115. The Samson beam 170 can be connected through a cable 165 to the polished rod. The horsehead 120 translates the rotational motion from the motor base 105 into the reciprocating motion of the polished rod 135, which reciprocates through the wellhead 125 and into the oil well. At the end of the polished rod 135 or a string of sucker rods is the plunger 155 that is the main mechanical driver of fluid out of the oil well. Around the polished rod 135 and within the oil well is a casing 140 that surrounds tubing 145. Together, the casing 140 and tubing 145 form a casing-tubing annulus that surrounds the subsurface pump 175 components. Sucker rod string 150, composed of sucker rods, runs inside the tubing string of the well and provides the mechanical link between the surface drive and the subsurface pump 175.

The barrel 160 of the pump 175 or working barrel is the stationary part of the subsurface pump 175 that serves as a stopping point for the plunger 155. The barrel 160 contains a standing valve that acts together with the plunger 155 as a suction valve through which well fluids enter the pump barrel during an upstroke when the standing valve is opened. The plunger 155 may include a traveling valve that opens during a downstroke and enables production fluids to flow through the traveling valve toward the surface. During a subsequent upstroke, the traveling valve closes, and production fluids trapped above the closed traveling valve may be lifted toward the surface. Such devices are disclosed and further described, for example, in U.S. patent application Ser. No. 17/483,753, filed Sep. 23, 2021, the disclosure of which is hereby incorporated in its entirety by this reference.

Coatings according to embodiments disclosed herein may be used on one or more interacting wear surfaces of the sucker rod pumping system 100 (e.g., surfaces of the plunger 155 and/or the barrel 160). For example, an interior surface 180 of the barrel 160 that interacts with an exterior surface 185 of the plunger 155 during operation of the subsurface pump 175 may comprise such coatings. In addition to, or alternate from, the exterior surface 185 of the plunger 155 may comprise such coatings.

In additional embodiments, such coatings may be applied to other wear surfaces, such as, for example, those on one or more couplings of the sucker rod pumping system 100 (e.g., rod couplings 190) and/or surfaces of the sucker rods of the rod string 150. In yet additional embodiments, the coatings may be applied on any suitable surface (e.g., a wear surface or otherwise) as is desirable in any number of applicable applications. For example, as discussed below in relation to FIGS. 8 through 10, one or more coatings according to embodiments of the disclosure may be used on one or more components of an oil and gas well system (e.g., artificial lift components).

Figure 2:
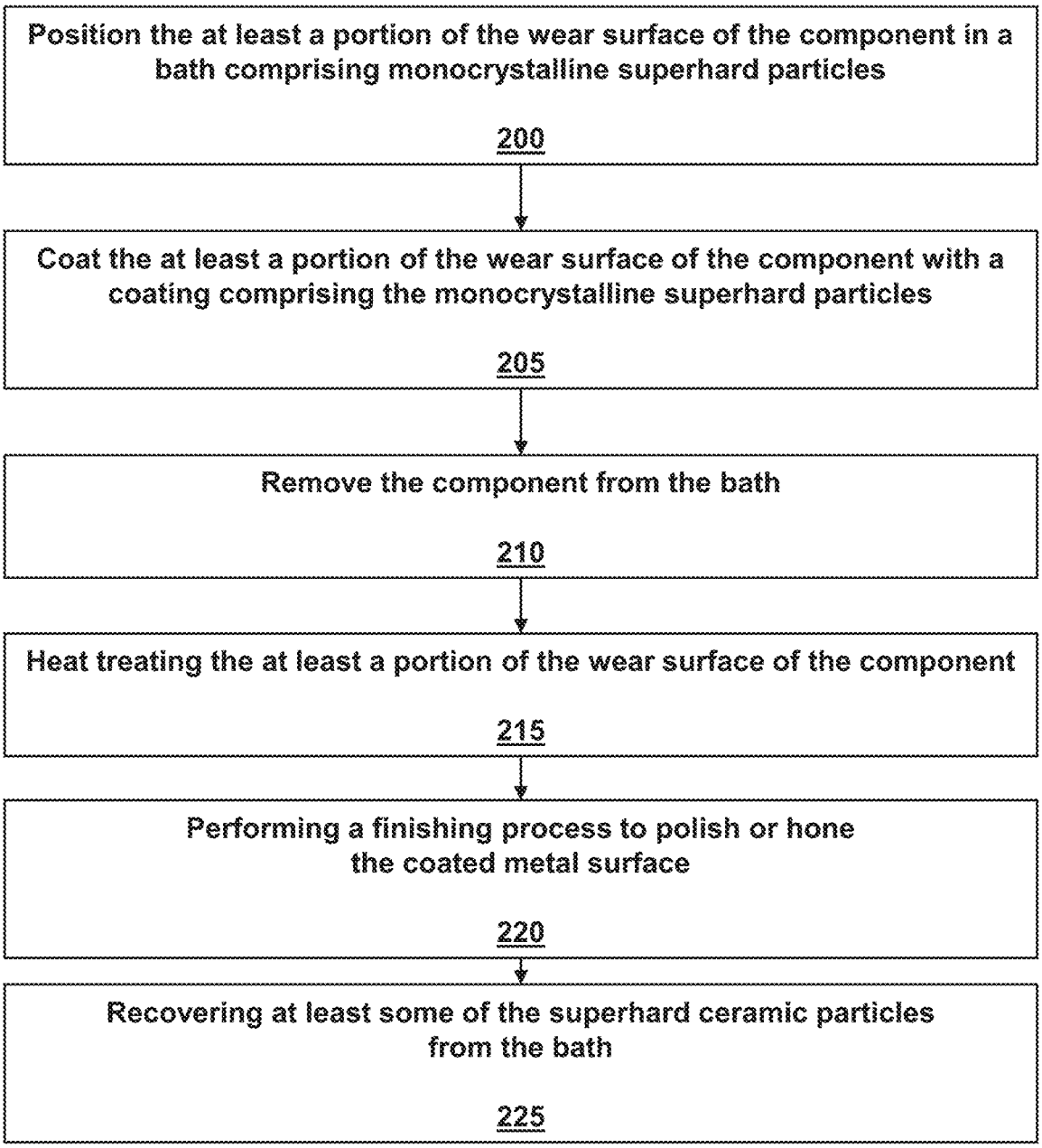
FIG. 2 illustrates a flow chart of a method of applying a coating on at least one component of a downhole pumping system in accordance with embodiments of the present disclosure.

FIG. 2 illustrates a process for applying a coating to a component (e.g., a wear surface of a component). For example, the component may comprise a downhole component of a sucker rod pumping system 100, such as those discussed above in relation to FIG. 1. The coating may comprise a metal-based ceramic composite that is applied to a base or wear surface of the component (e.g., a metal surface) via a coating or plating process (e.g., an electroless plating process). For example, electroless plating may be implemented to plate one or more metal surfaces of the component by chemical methods (e.g., rather than electrical methods) in which the surface to be plated is immersed in a reducing agent that, when catalyzed by certain materials, changes metal ions to metal that forms a deposit on the surface. In additional embodiments, chemical or other methods may be implemented to apply the coatings on a selected component (e.g., electroplating).

As shown in FIG. 2, at act 200, a bath may be prepared including the ceramic particles in a fluid metallic coating matrix (e.g., an autocatalytic metal plating bath). In some embodiments, the ceramic particles may be dispersed in the metal plating bath using a continuous agitation method. As discussed above, the ceramic particles may comprise single crystalline (e.g., monocrystalline) particles (e.g., diamond particles or another material such as those discussed above). In some embodiments, the monocrystalline particles may exhibit a size range (e.g., an outer dimension) of about 0.1 μm to 12 μm (e.g., 0.1 μm to 3 μm, 1 μm to 2 μm, 7 μm to 10 μm). The metal plating bath in which the monocrystalline particles are dispersed may contain alloys of one or more nickel, phosphorous, cobalt, and/or chromium. For example, the bath may include nickel or nickel-cobalt and phosphorous where the phosphorous content is less than 20% (e.g., less than 15%, less than 13%, less than 10%, etc.) of the overall coating metal plating bath. In some embodiments, the volume fraction of the ceramic particles in the coating material may be between approximately 10% to 30% of the bath (e.g., 10% to 25%, 17%, 15% to 19%, 25% to 27%).

At act 205, one or more surfaces or portions of the component may be placed in the bath in order to deposit the coating on the surface of the component (e.g., through an electroless plating process).

At act 210, the component may be removed with the coating on the surface of the component. In some embodiments, the coating may exhibit a thickness between approximately 10 μm to 400 μm (e.g., 10 μm to 125 μm, 10 μm to 300 μm, 0.1 μm to 200 μm, 1 μm to 200 μm, or combinations thereof).

After application, the deposited coating may exhibit an amorphous structure and, at act 215, the coating may be heat treated to partially crystalize and precipitate the hard intermetallic compounds (e.g., a $Ni_3P$ compound where nickel and phosphorus are implemented in the metal matrix material). The crystallization percentage of the coating may be based on the selected heat treatment temperature and holding time at that temperature that is applied to the coating. In some embodiments, the heat treatment of the deposited coating may to increase the hardness of the coating (e.g., by precipitation of the intermetallic phase) and act enable the control of the mechanical properties of the composite coating so that the desired hardness and wear resistance may be obtained. For example, in some embodiments, the hardness of the final coating may reach a hardness of up to 1300-2000 $HV_{0.1}$ (e.g., 1800-2000 $HV_{0.1}$).

As discussed above, where coatings are implemented on two or more mating components (e.g., components that move relative to one another), one or both (e.g., all) of the components may include coatings according to embodiments herein (e.g., coatings on an inner diameter and an outer diameter). When coatings (e.g., a similar or the same coating) are applied on both of the two mating components, two different heat treatment processes for hardness may be implemented as a differentiator between the coatings as may be beneficial for selected applications. For example, two mating components having similar or substantially the same hardness may promote a galling effect between the components. To avoid such a galling effect, different heat treatments may be applied to each component. For example, in relatively moving components, a stationary component may receive a heat treatment that results in a higher hardness of the coating and the moving component may receive a heat treatment that results in a lower hardness of the coating. By way of further example, in a downhole pump application, as is discussed above, the plunger and the barrel may be coated similarly; however, two different treatments may be applied to result in a relatively lower plunger hardness as compared to the hardness of the barrel, resulting in application benefits and avoidance or minimization of galling effects.

At act 220, a finishing process may be applied to the coating to polish or hone the coated metal surface and prepare it for contact with other surfaces. In some embodiments, the polishing technique may be designed to reduce surface roughness and reduce the friction coefficient of the composite coating. During the polishing, sliding contact between one or more polishing elements and the coating that is applied during the polishing process may enable the single crystalline particles in the coating to develop a relatively lower friction coefficient. As discussed above, in some embodiments, such a relatively lower friction coefficient may be obtained by the virtue of the high breakage and/or shear resistance of the single crystalline particles as compared to polycrystalline particles, which tend to break due to different orientations of their grains. As a result, the tribolayer (e.g., lubricant layer) forming during the sliding contact of single crystalline particles may be improved as compared to polycrystalline particles.

Figure 3:
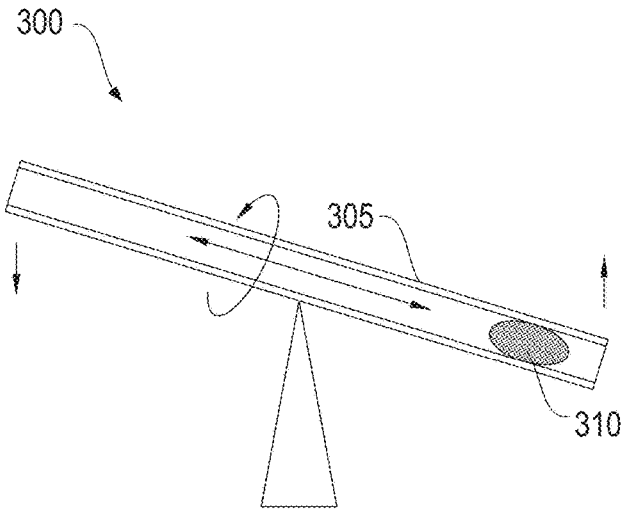
FIG. 3 depicts an exemplary polishing process in accordance with embodiments of the present disclosure.

FIG. 3 depicts an exemplary polishing process 300 that may be implemented on interior surfaces (e.g., an inner diameter) of an at least partially hollow component 305 (e.g., the barrel 160 as shown in FIG. 1). As shown in FIG. 3, one or more elements (e.g., a substantially ellipsoidal or spherical element 310, a number of ellipsoidal balls, etc.) may slide within the component 305 to polish the inside wear surface of the component 305. In some embodiments, the polishing element 310 may comprise one or more superhard materials (e.g., tungsten carbide) in order to smooth the ceramic coating.

In additional embodiments, other type of elements may be implanted for the polishing (e.g., a continuous rotational belt, etc.).

In some embodiments, the movement of the polishing element 310 relative to the component 305 may occur in more than one type of relative movement (e.g., translation and rotation). For example, as depicted, the polishing element 310 may translate along an axis extending through the component 305 (e.g., via a lever configuration). The polishing element 310 may also rotate about the axis (e.g., or another axis) relative to the component 305. Such movement may enable the polishing element 310 to roll (e.g., tumble) within and relative to the component 305 in multiple directions.

Figure 4:
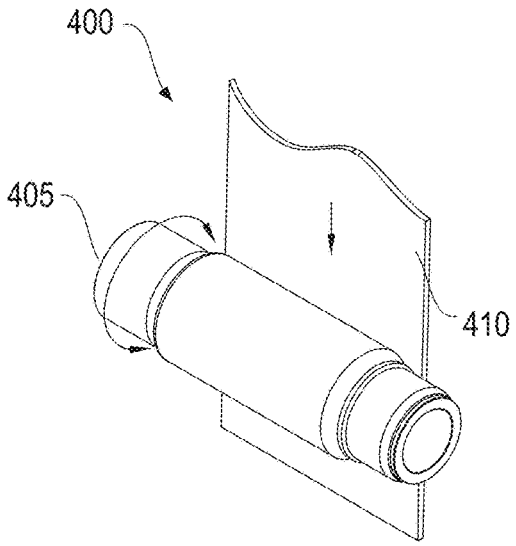
FIG. 4 depicts another exemplary polishing process in accordance with embodiments of the present disclosure.

FIG. 4 depicts an exemplary polishing process 400 that may be implemented on an exterior surfaces (e.g., an outer diameter) of a component 405 (e.g., the plunger 155 as shown in FIG. 1). As shown in FIG. 4, one or more elements (e.g., a substantially planar element 410) may slide over the component 405 in one or more directions of movement to polish the component 405 in a manner similar to that discussed above. In some embodiments, the substantially planar element 410 may comprise similar materials as the substantially ellipsoidal element 310 discussed above (e.g., superhard materials).

Referring back to FIG. 2, at act 225, in some embodiments, after removing the component, at least some of the superhard ceramic particles may be recovered from the bath. Such a recovery process may be implemented to increase the efficiency or commercial viability of the coating process by reclaiming the superhard particles from the coating solution (e.g., the fluid matrix) between uses. Such reclaiming may enable the reuse of the superhard particles and/or may ensure that a selected concentration of superhard particles is maintained in the coating bath.

Figure 5:
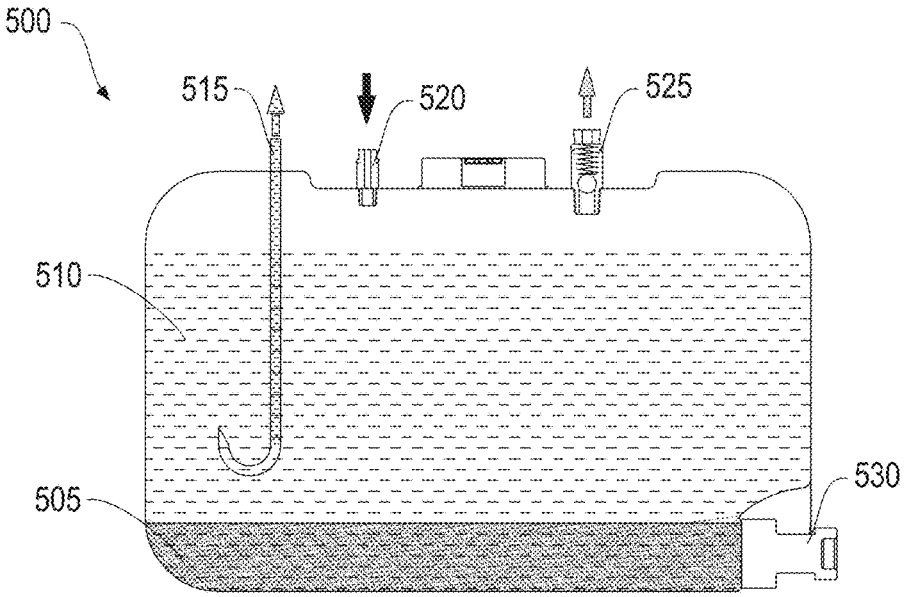
FIG. 5 depicts an exemplary system including a container for performing a recovery process of undeposited superhard particles in accordance with embodiments of the present disclosure.

FIG. 5 depicts an exemplary system including a container 500 for performing such a recovery process where the undeposited superhard particles 505 may be recovered from the fluid matrix 510 and reused in a plating bath solution in subsequent processes. The recovery process may utilize the density of superhard particles 505, which causes the superhard particles to be precipitated and settle at the bottom of the container 500. After precipitation of the superhard particles 505, the solution may be removed from the upper section of the container 500 (e.g., via fluid separation tube 515 that operates via a J-tube method for extracting the fluid while the relatively heavier particles 505 remain in the container 500).

In some embodiments, the container 500 may include valves (e.g., air valve 520 and pressure relief valve 525) to assist in the removal (e.g., pressurized removal) of the fluid matrix 510. For example, pressurizing the fluid in the container 500 may act to keep the relatively heavier superhard particles 505 down in the container 500 (e.g., at a lower or lowermost position in the container 500).

After removal of a majority of the fluid matrix 510 (e.g., substantially all of the fluid matrix 510), the superhard particles 505 may be removed from the bottom section of the container 500. For example, the superhard particles 505 may be removed through a lower opening or valve 530 in the container 500. The superhard particles 505 may be subjected to a drying procedure where the recovered superhard particles 505 from the container 500 are placed in an oven (e.g., operated with inset gas to prevent oxidation) to dry out the superhard particles 505 for subsequent use.

In some embodiments, the solution in the bath may be maintained at a neutral or slightly acidic pH (e.g., a pH of 5 to 7 or less) to promote separation (e.g., precipitation) of the superhard particles 505 in the bath.

Figure 6:
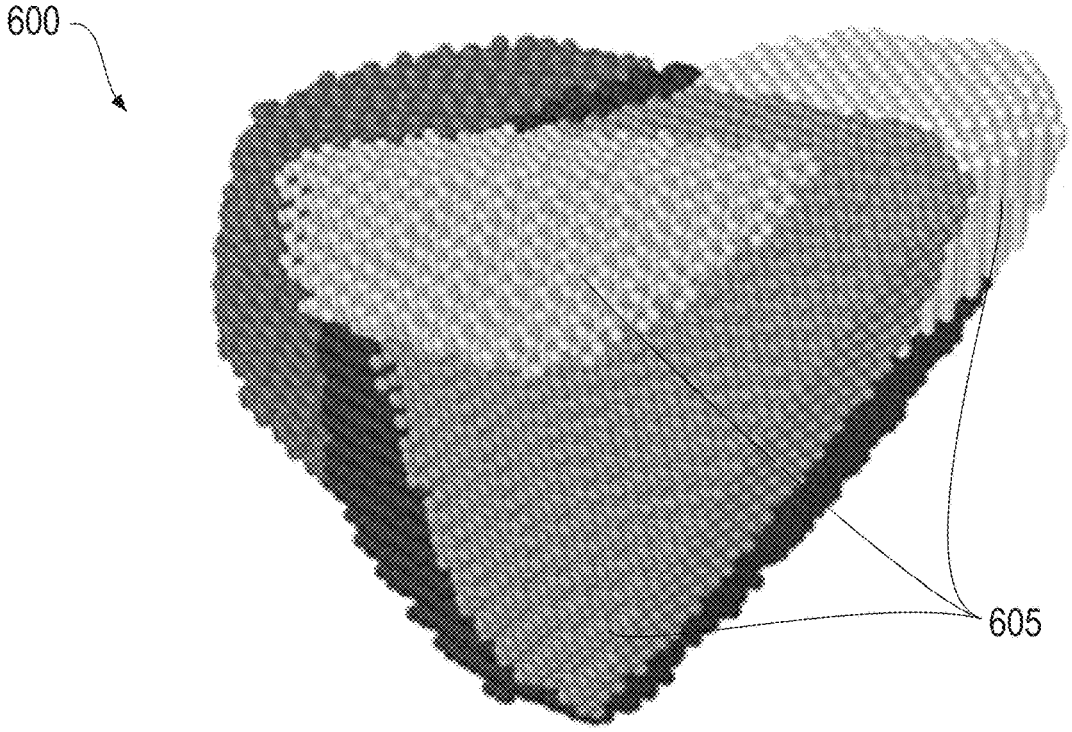
FIG. 6 illustrates a superhard polycrystalline particle for use in a coating.
Figure 7:
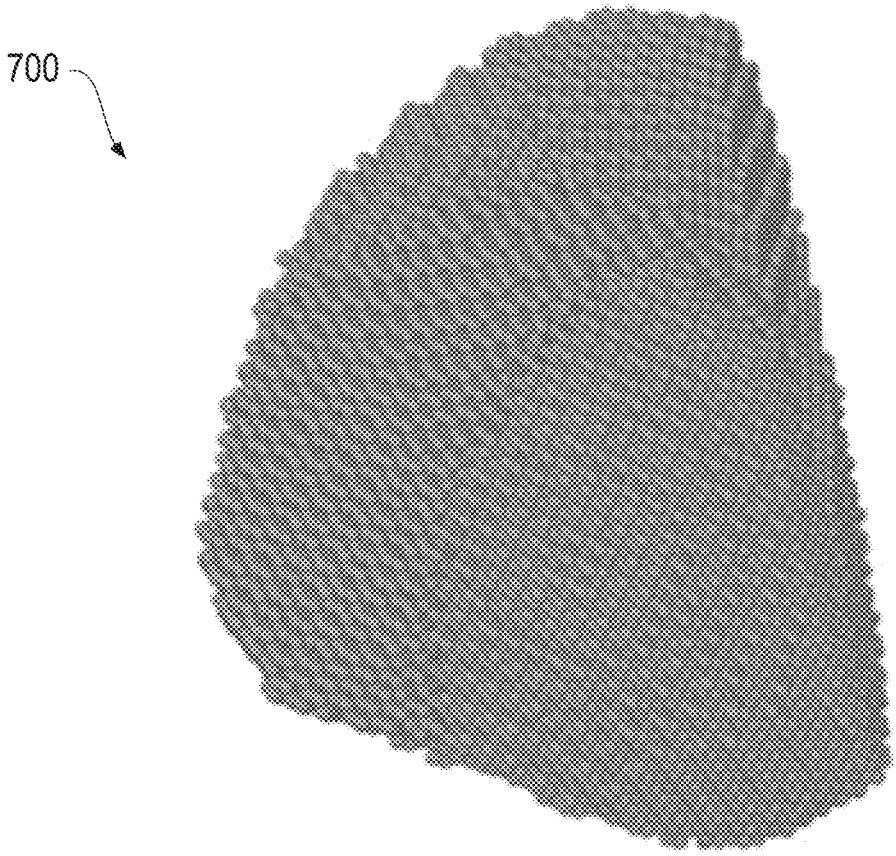
FIG. 7 illustrates a superhard monocrystalline particles for use in a coating in accordance with embodiments of the present disclosure.

FIGS. 6 and 7 illustrate superhard crystalline particles that may be utilized in a coating process. As shown in FIG. 6, a polycrystalline superhard particle 600 (e.g., polycrystalline diamond) includes numerous grains 605 or crystallites of varying size and/or orientation that are fused together. Each of the grains 605 exhibits grain boundaries between the grain 605 and adjacent fused grains. As shown in FIG. 7, in contrast to the polycrystalline superhard particle 600, and as discussed above, a monocrystalline superhard particle 700 (e.g., monocrystalline diamond) may be selected for use in embodiments of the coatings disclosed herein. Such monocrystalline superhard particles 700 may substantially exhibit a single crystalline structure having a substantially single grain orientation that substantially lacks multiple grains or grain boundaries within the structure of the monocrystalline particle 700. Stated in another way, the monocrystalline particle 700 substantially does not include a polycrystalline structure having multiple grains 605 and grain orientations that define grain boundaries between the crystallites as is typical in the polycrystalline superhard particle 600.

Exemplary testing of such coatings using an ASTM G174 Abrasive Wear Test showed that coatings according to embodiments of the disclosure exhibited substantially less wear (e.g., a substantially smaller visible wear scar) than those with a silicon carbide (SiC) coating. For example, the average hardness of components including monocrystalline diamond coatings according to some embodiments herein (e.g., having about a 25% volume fraction and a 1 μm to 3 μm average particle size) exhibited a hardness (e.g., 1500 $HV_{0.05}$) that was higher by approximately 75% than a conventional SiC coating. Thus, such testing may illustrate the viability coatings in accordance with embodiments of the instant disclosure that include monocrystalline crystalline coatings.

Figure 8:
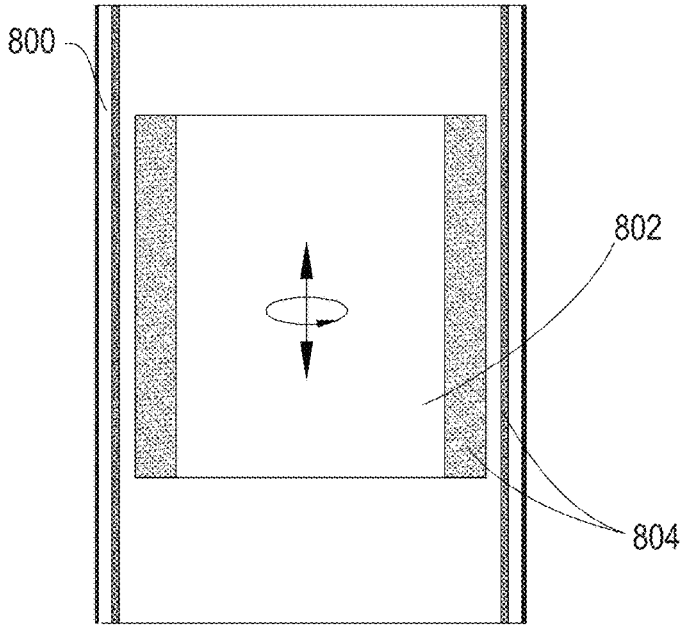
FIGS. 8 through 10 are elevational views of a components of an oil and gas well system that may include one or more coatings according to embodiments of the disclosure, where embodiments of the coating may be applied to the first and/or second wear components of a well pump, a well component, a well system, and/or a well head.
Figure 9:
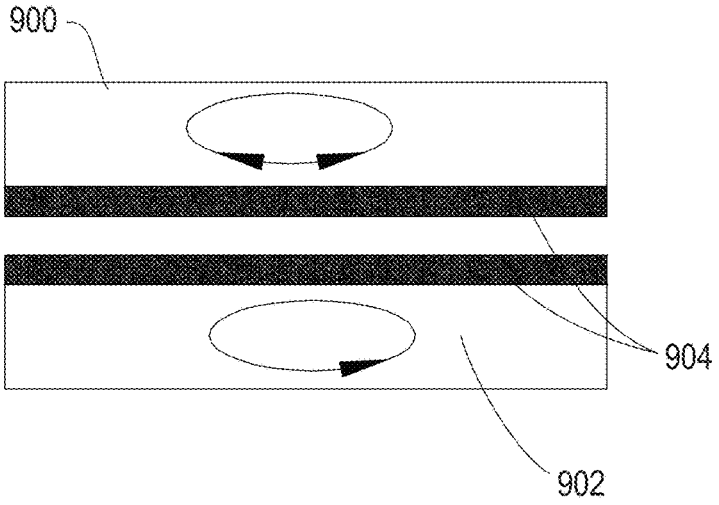
Figure 10:
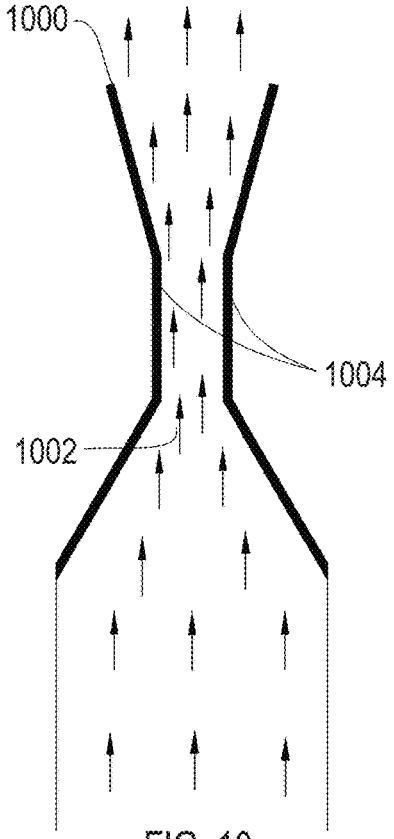

FIGS. 8 through 10 are elevational views of a components of an oil and gas well system that may include one or more coatings. As shown in FIG. 8, such coatings may be applied on two relatively moving components with an inner component 800 that may move linearly (e.g., translate) and/or rotate relative to an outer component 802 (e.g., an outer sleeve). Such a configuration may be implemented in assemblies such as, for example, plunger lifts, jet lifts, rod lifts, or electrical submersible pumps (ESPs). As depicted, one or both of the components 800, 802 may include a coating 804 on mating surfaces of the component 800, 802 and/or on non-mating outer surfaces, which are in contact with well fluid for corrosion resistance Such coatings 804 may exhibit a thickness similar to those discussed above (e.g., 10 μm to 200 μm, 10 μm to 400 μm, etc.).

As shown in FIG. 9, such coatings may be applied on two relatively moving components with a first component 900 that rotates in one or more directions relative to a second component 902. Such a configuration may be implemented in assemblies such as, for example, in thrust bearings, such as those implemented in a downhole electrical submersible pump (ESP). As depicted, one or both of the components 900, 902 may include a coating 904 on mating surfaces of the component 900, 902. Such coatings 904 may exhibit a thickness similar to those discussed above (e.g., 10 μm to 400 μm, etc.).

As shown in FIG. 10, such coatings may be applied on one or more components 1000 that is subject to wear environments (e.g., subject to fluid flow 1002, which may erode or other damage the one or more components 1000, due to erosion and/or cavitation during high pressure fluid flow). Such a configuration may be implemented in assemblies such as, for example, jet lifts, well head valves, etc. As depicted, the component 1000 may include a coating 1004 on wear surfaces of the component 1000, which coatings 1004 may exhibit a thickness similar to those discussed above.

Figure 11:
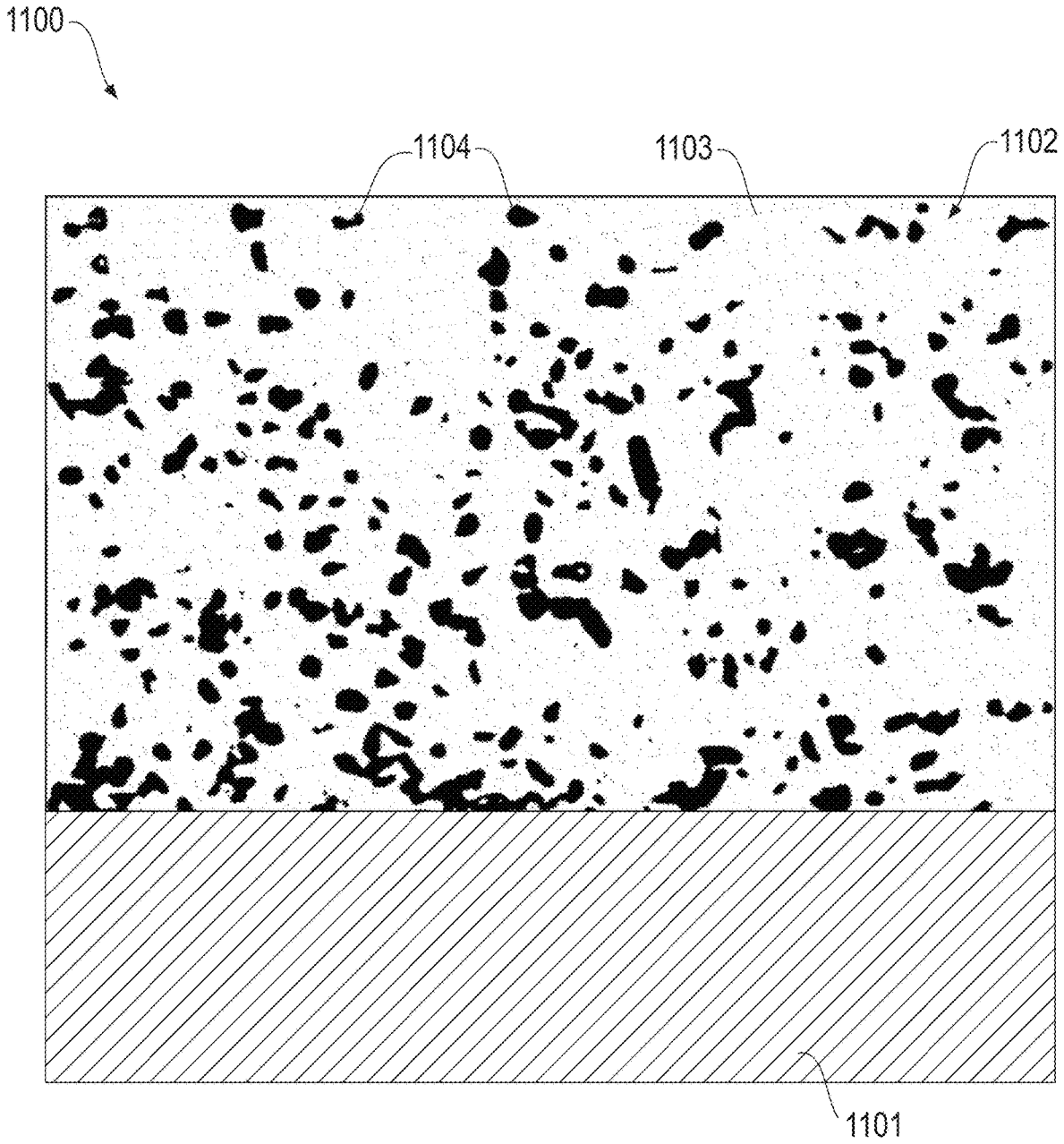
FIG. 11 illustrates a coated component including a metal substrate being plated with a deposited coating with monocrystalline superhard ceramic particles dispersed within a metallic matrix according to some embodiments of the disclosure.

FIG. 11 illustrates a coated component 1100 including a metal substrate 1101 being plated with a deposited coating 1102. The deposited coating includes monocrystalline superhard ceramic particles 1104 dispersed within a metallic matrix 1103. As shown in FIG. 11, after the coating application on base material 1101, the deposited coating 1102 may be heat treated to partially crystalize and precipitate hard intermetallic compounds in the metallic matrix 1103. For example, the hard intermetallic compounds in the metallic matrix 1103 may comprise a Ni3P compound, where nickel and phosphorus are precipitated within the metallic matrix 1103 the monocrystalline superhard ceramic particles 1104, such as, for example, monocrystalline diamond, monocrystalline cubic boron nitride (CBN), silicon monocrystalline carbide, monocrystalline intermetallic (e.g., carbides), or ceramics.

Terms of degree (e.g., "about," "substantially," "generally," "approximately," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, et cetera.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. Further, the words "including," "having," and variants thereof (e.g., "includes" and "has") as used herein, including the claims, shall be open-ended and have the same meaning as the word "comprising" and variants thereof (e.g., "comprise" and "comprises"). In addition, features from one embodiment may be combined with features of another embodiment while still being encompassed within the scope of the disclosure as contemplated by the inventors.

What is claimed is:

1. An assembly for an oil and gas well system, the assembly comprising:

a first component having a first wear surface;

a second component having a second wear surface that at least partially contacts the first wear surface of the first component during relative movement between the first component and the second component; and a first metal-based ceramic composite coating defining a contact portion of the first wear surface of the first component that is configured to contact the second wear surface of the second component, the first metal-based ceramic composite coating comprising first monocrystalline superhard particles dispersed in a first metal matrix, the contact portion of the first wear surface including the first monocrystalline superhard particles, wherein the first metal-based ceramic composite coating is polished at the contact portion of the first wear surface, wherein the polished contact portion of the first wear surface of the first metal-based ceramic composite coating is formed by sliding one or more ceramic elements comprising a superhard material having a blunt polishing surface over or within the contact surface in more than one type of relative motion, the more than one type of relative motion comprising at least translation and rotation, wherein the polishing of the polished contact portion is configured to provide a relatively reduced friction coefficient of the polished contact portion and configured to reduce surface roughness of the polished contact portion.

2. The assembly of claim 1, further comprising:

a second metal-based ceramic composite coating defining a contact portion of the second wear surface of the second component that is configured to contact the first wear surface of the first component, the second metal-based ceramic composite coating comprising second monocrystalline superhard particles dispersed in a second metal matrix; and wherein the first monocrystalline superhard particles have the same hardness as the second monocrystalline superhard particles, and the first metal matrix has a different hardness than the second metal matrix.

3. The assembly of claim 2, wherein the first component and the second component are each heat treated to produce the differing hardness of the first metal matrix and the second metal matrix.

4. The assembly of claim 3, wherein at least one of the first metal-based ceramic composite coating or the second metal-based ceramic composite coating is heat treated to produce a selected hardness of 1300-2000 $HV_{0.1}$ on the at least one of the first wear surface of the first component or the second wear surface of the second component.

5. The assembly of claim 1, wherein a material of the first metal matrix comprises at least one of nickel, phosphorous, or cobalt.

6. The assembly of claim 1, wherein the first monocrystalline superhard particles comprise single crystalline superhard particles that comprise a single grain orientation and lack grain boundaries.

7. The assembly of claim 6, wherein the first metal-based ceramic composite coating lacks a polycrystalline superhard material.

8. The assembly of claim 1, wherein the one or more ceramic elements comprises one or more substantially ellipsoidal elements.

9. The assembly of claim 1, wherein the first monocrystalline superhard particles comprise at least one of monocrystalline diamond particles that comprise a single grain orientation, monocrystalline cubic boron nitride (CBN), silicon monocrystalline carbide, or monocrystalline intermetallics or ceramics.

10. The assembly of claim 1, wherein the assembly comprises a wear part of a pump, a lift system, a wellhead, a valve, a load bearing component, at least one of a barrel of a pump, a plunger of the pump, a rod coupled to a downhole pump, a coupling between one or more components, a sand separator assembly of the oil and gas well system, wear parts of a ESP pump system, wear parts of a plunger lift pump system, wear parts of a jet pump lift system a wellhead, a valve, a diffuser of pump, an impeller of pump, a casing, a thrust bearing of a ESP protector assembly, an ESP motor assembly, a lubricator assembly, plunger pads and/or rings, a plunger assembly, a bottom hole bumper spring assembly, a throat and/or a diffusor of jet lift system, or a jet nozzle.

11. A method of producing a metal-based ceramic composite coating on at least a portion of a wear surface of the assembly of claim 1 for use in the oil and gas well system, the method comprising:

positioning at least a portion of the first wear surface of the first component in a metal plating bath comprising the monocrystalline superhard particles in the metallic matrix;

coating the at least a portion of the first wear surface of the first component with the metal-based ceramic composite coating;

removing the component from the metal plating bath; and heat treating the at least a portion of the first wear surface of the component.

12. A component for use in an oil and gas well system, the component comprising:

an element having a wear surface configured to move relative to and at least partially contact another component of an oil and gas well pumping assembly; and a metal-based ceramic composite plating defining an exposed portion of the wear surface, the metal-based ceramic composite plating comprising superhard monocrystalline particles dispersed in a metal matrix, the exposed portion of the metal-based ceramic composite coating exhibiting a polished surface, the polished surface of the metal-based ceramic composite coating being formed by sliding a ceramic material having a blunt surface on the metal-based ceramic composite coating in more than one type of relative motion, the more than one type of relative motion comprising at least translation and rotation, wherein the forming of the polished surface is configured to provide a relatively reduced friction coefficient of the polished surface and configured to reduce surface roughness of the polished surface.

13. The component of claim 12, wherein the metal-based ceramic composite plating lacks any superhard polycrystalline material.

14. An assembly for an oil and gas well system, the assembly comprising:

a first component comprising a plunger having a first wear surface;

a second component comprising a barrel having a second wear surface that at least partially contacts the first wear surface of the first component during relative movement between the first component and the second component; and a metal-based ceramic composite coating defining the first wear surface of the plunger and the second wear surface of the barrel, the metal-based ceramic composite coating comprising monocrystalline superhard particles dispersed in a metal matrix, wherein the monocrystalline superhard particles of the first wear surface are the same as the monocrystalline superhard particles of the second wear surface, and wherein the metal matrix of the first wear surface of the plunger comprises a first hardness that is less than a second hardness of the metal matrix of the second wear surface of the barrel, wherein the metal-based ceramic composite coating exhibits a multi-directionally honed surface, the multi-directionally honed surface configured to provide a relatively reduced friction coefficient and configured to provide reduced surface roughness.

15. The assembly of claim 14, wherein the metal-based ceramic composite coating on the first wear surface of the first component is the same as the metal-based ceramic composite coating on the second wear surface of the second component when applied and prior to a heat treatment, and wherein the first component and the second component are each heat treated to produce the first hardness and the second, differing hardness on each of the first wear surface and the second wear surface.

16. The assembly of claim 14, wherein the honed surface of the metal-based ceramic composite coating is formed by sliding one or more substantially ellipsoidal or spherical ceramic elements over or within the honed surface.

17. The assembly of claim 14, wherein the metal-based ceramic composite coating lacks a polycrystalline superhard material.

18. The assembly of claim 14, wherein an inner surface of the first component and an outer surface of the second component comprises the metal-based ceramic composite coating.

19. The assembly of claim 14, wherein the monocrystalline superhard particles comprise at least one of monocrystalline diamond particles that comprise a single grain orientation, monocrystalline cubic boron nitride (CBN), silicon monocrystalline carbide, or monocrystalline intermetallics or ceramics.

* * * * *